US009017911B2

(12) United States Patent
Kouyama et al.

(10) Patent No.: US 9,017,911 B2
(45) Date of Patent: Apr. 28, 2015

(54) ELECTROPHOTOGRAPHIC TONER

(75) Inventors: Mikio Kouyama, Tokyo (JP); Yasuhiko Muramatsu, Tokyo (JP); Kenji Hayashi, Tokyo (JP); Hiroaki Obata, Tokyo (JP); Noriyuki Kimpara, Tokyo (JP); Hiroshi Nagasawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1023 days.

(21) Appl. No.: 12/919,133

(22) PCT Filed: Jun. 26, 2009

(86) PCT No.: PCT/JP2009/061713

§ 371 (c)(1),
(2), (4) Date: Aug. 24, 2010

(87) PCT Pub. No.: WO2010/001826

PCT Pub. Date: Jan. 7, 2010

(65) Prior Publication Data

US 2011/0008721 A1 Jan. 13, 2011

(30) Foreign Application Priority Data

Jul. 3, 2008 (JP) ..... 2008-174517

(51) Int. Cl.
*G03G 9/087* (2006.01)
*G03G 9/097* (2006.01)

(52) U.S. Cl.
CPC ..... *G03G 9/09733* (2013.01); *G03G 9/08782* (2013.01)

(58) Field of Classification Search
CPC ..... G03G 9/087; G03G 9/097
USPC ..... 430/108.4
See application file for complete search history.

(56) References Cited

U.S. PATENT DOCUMENTS

| | | | | |
|---|---|---|---|---|
| 5,998,080 | A * | 12/1999 | Ohno et al. | 430/45.54 |
| 6,153,347 | A * | 11/2000 | Kabai et al. | 430/108.4 |
| 6,316,157 | B1 * | 11/2001 | Yoshikawa et al. | 430/108.3 |
| 2004/0265729 | A1 | 12/2004 | Patel | |
| 2006/0188802 | A1 * | 8/2006 | Koyama et al. | 430/108.4 |
| 2007/0111127 | A1 * | 5/2007 | Patel et al. | 430/108.4 |
| 2007/0111128 | A1 | 5/2007 | Patel | |

FOREIGN PATENT DOCUMENTS

| | | | |
|---|---|---|---|
| JP | 2001-305778 | A | 11/2001 |
| JP | 2001-305791 | A | 11/2001 |
| JP | 2001-305792 | A | 11/2001 |
| JP | 2006-215158 | A | 8/2006 |
| JP | 2008-064837 | A | 3/2008 |

* cited by examiner

*Primary Examiner* — Peter Vajda
*Assistant Examiner* — Olatunji Godo
(74) *Attorney, Agent, or Firm* — Lucas & Mercanti, LLP

(57) ABSTRACT

In the present invention, provided is an electrophotographic toner in which low temperature fixing is achieved, and high storage stability is obtained without generating tacking with respect to fixed images to be formed. It is a feature that this electrophotographic toner possesses at least a binder resin, a colorant and a releasing agent, wherein the releasing agent comprises an ester compound and an aliphatic hydroxycarboxylic acid compound.

6 Claims, No Drawings

ELECTROPHOTOGRAPHIC TONER

This is a 371 of PCT/JP2009/061713 filed Jun. 26, 2009 which in turn claimed the priority of Japanese Patent Application No. 2008-174517 filed Jul. 3, 2008, both applications are incorporated by reference herein.

TECHNICAL FIELD

The present invention relates to an electrophotographic toner utilized for image formation in an electrophotographic system.

BACKGROUND

In recent years, energy saving for an electrophotographic image forming apparatus has been demanded, and studies on so-called low temperature fixing by which fixing is conducted at lower temperature than in the past have been done in order to reduce energy consumption of a fixing device consuming the largest electric power in the image forming apparatus. As a technique to achieve the low temperature fixing, for example, a toner containing a binder resin exhibiting a low softening point and a low glass transition point temperature has been studied so as to smoothly conduct toner fusion even at low fixing temperature.

However, there appears a problem such that in the case of the toner with one exhibiting such a low softening point and such a low glass transition point temperature, toner-to-toner coagulation is easy to be generated by heat at high temperature during storage, and thither, there is another problem such that so-called tacking, by which image supports are attached to each other when fixed images having been formed with the toner are piled, is easy to be generated.

It is known that a toner particle constituting the toner can be designed to be one having a core/shell structure in which the surface of a toner mother particle is covered with a resin exhibiting high glass transition point temperature to improve toner-to-toner coagulation during storage.

On the other hand, in the situation where generation of tacking is dependent upon properties of a binder resin constituting a toner particle, that is, high or low glass transition point temperature of the binder resin, generation of tacking and achievement of low temperature fixing thereof are in the trade-off relationship, and the problem caused by this trade-off relationship has not yet been solved.

PRIOR ART DOCUMENT

Patent Document

Patent Document 1: Japanese Patent O.P.I. Publication No. 2008-64837.

DISCLOSURE OF THE INVENTION

Problems to be Solved by the Invention

The present invention has been made on the basis of the above-described situation, and it is an object of the present invention to provide an electrophotographic toner in which low temperature fixing is achieved, and high storage stability is obtained without generating tacking with respect to fixed images to be formed.

Means to Solve the Problems

An electrophotographic toner of the present invention contains at least a binder resin, a colorant and a releasing agent, wherein the releasing agent contains at least an ester compound and an aliphatic hydroxycarboxylic acid compound.

The ester compound contained in the electrophotographic toner as the releasing agent possesses an ester formed by reacting an aliphatic hydroxycarboxylic acid compound and at least one of a long chain alkyl alcohol compound and a long chain alkenyl alcohol compound.

Further, the aliphatic hydroxycarboxylic acid compound contained in the releasing agent preferably has a content of 0.1-10% by weight, based on the total weight of the releasing agent, and more preferably has a content of 0.5-7% by weight.

Further, the aliphatic hydroxycarboxylic acid compound contained in the releasing agent is preferably at least one selected from the group consisting of a citric acid, a malic acid and a tartaric acid.

Further, as to the electrophotographic toner of the present invention, an aliphatic hydroxycarboxylic acid compound constituting the ester compound contained in the releasing agent preferably has the same structure as that of the aliphatic hydroxycarboxylic acid compound contained in the releasing agent.

Further, as to the electrophotographic toner of the present invention, an alcohol component to form the ester compound has 16-40 carbon atoms.

Further, as to the electrophotographic toner of the present invention, the releasing agent possesses at least one of the long chain alkyl alcohol compound and the long chain alkenyl alcohol compound, and the at least one of the long chain alkyl alcohol compound and the long chain alkenyl alcohol compound in the releasing agent preferably has a content of 2-15% by weight, based on the total weight of the releasing agent.

And, as to the electrophotographic toner of the present invention, the at least one of the long chain alkyl alcohol compound and the long chain alkenyl alcohol compound in the foregoing releasing agent preferably has the same structure as that of an alcohol component constituting the ester compound contained in the forgoing releasing agent.

Effect of the Invention

As to an electrophotographic toner of the present invention, by containing at least an ester compound and an aliphatic hydroxycarboxylic acid compound in a releasing agent constituting the toner, low temperature fixing for a toner was achieved, and high storage stability of fixed images was possible to be obtained without generating tacking between the fixed images having been formed with the toner.

The reason is presumably that hardness on the surface of the resulting fixed image can be increased at room temperature via action of the aliphatic hydroxycarboxylic acid compound contained in the releasing agent, and as a result, detachability between the fixed images is improved, whereby high storage stability has been obtained without generating tacking.

DESCRIPTION OF THE PREFERRED EMBODIMENTS

Next, the electrophotographic toner of the present invention will be described in detail.

The electrophotographic toner of the present invention (hereinafter, also referred to simply as "tone") contains at least a binder resin, a colorant and a releasing agent, and the releasing agent contains at least an ester compound and an aliphatic hydroxycarboxylic acid compound. Next, the ester compound and the aliphatic hydroxycarboxylic acid compound contained in the releasing agent will be described below.

[Ester Compound]

The ester compound contained in the releasing agent constituting the toner of the present invention is an ester compound formed from a carboxylic acid compound and an alcohol compound, and a structure thereof preferably has a long chain aliphatic group. Specifically preferable is an ester compound formed by reacting an aliphatic hydroxycarboxylic acid compound and at least one of a long chain alkyl alcohol compound and a long chain alkenyl alcohol compound (hereinafter, also referred to collectively as "long chain aliphatic alcohol compound").

Examples of such an ester compound include an ester compound formed from a long chain aliphatic monoalcohol component and a long chain aliphatic monocarboxylic acid component, an ester compound formed from a polyalcohol component and a long chain aliphatic monocarboxylic acid component, and an ester compound fanned from a polycarboxylic acid component and a long chain aliphatic monoalcohol component.

Specific examples of the above-described ester compounds containable in the releasing agent will be cited herein. Specific examples of the ester compound containable in the releasing agent include tribehenyltristearyl citrate, distearyl malate, dibehenyl malate, distearyl tartrate, dibehenyl tartrate, stearyl stearate, behenyl behenate, glycerintristearyl, glycerintribehenyl, pentaerythritoltetrastearyl, and pentaerythritoltetrabehenyl. Of these, tribehenyl citrate, tristearyl citrate, distearyl malate, distearyl tartrate and dibehenyl tartrate are preferable, and tribehenyl citrate and tristearyl citrate are specifically preferable.

Ester compounds each contained in the releasing agent used in the toner of the present invention are possible to be used singly or in combination with at least two kinds.

Next, specific examples of the foregoing "aliphatic hydroxycarboxylic acid" and "long chain aliphatic alcohol" will be described.

As the aliphatic hydroxycarboxylic acid compound capable of forming the above-described ester compound, for example, provided are a hydroxyrnonocarboxylic acid, a hydroxydicarboxylic acid, a hydroxytricarboxylic acid, based on the number of carboxylic acid groups. Examples of the hydroxymonocarboxylic acid include a glycolic acid, a lactic acid, a glyceric acid, a hydroxybutyric acid, a leucine acid, a mevalonic acid, a pantoic acid, a ricinoleic acid, a ricinelaidic acid, a cerebronic acid, a wink acid, a shikimic acid and so forth. Examples of the hydroxydicarboxylic acid include a malic acid, a tartaric acid, a tartronic acid, a citramalic acid and so forth. Further, examples of the hydroxytricarboxylic acid include a citric acid and so forth. Among these aliphatic hydroxycarboxylic acid compounds, a citric acid, a malic acid and a tartaric acid are specifically preferable. In the present invention, the ester compound is possible to be formed by using the above-described aliphatic hydroxycarboxylic acid compounds singly or in combination with two kinds.

Next, the long chain aliphatic alcohol compound usable to form the ester compound contained in the releasing agent will be described. As to a long chain aliphatic alcohol compound usable to form the ester compound, the long chain aliphatic alcohol compound is preferably composed of a group having 16-40 carbon atoms.

Specific examples of such a long chain aliphatic alcohol compound include cetyl alcohol, stearyl alcohol, isostearyl alcohol, oleyl alcohol, palmitoleyl alcohol, elaidolinolenyl alcohol and behenyl alcohol. Of these, stearyl alcohol and behenyl alcohol are specifically preferable.

Further, the ester compound contained in the releasing agent is possible to contain an ester compound having the carboxylic acid component as described below in addition to an ester compound formed by using the foregoing aliphatic hydroxycarboxylic acid compound. As carboxylic acid compounds other than the aliphatic hydroxycarboxylic acid compound as described above, for example, provided are the following mono carboxylic acids, dicarboxylic acids and trivalent and more carboxylic acids.

Specific examples of the monocarboxylic acid include a formic acid, an acetic acid, a propionic acid, a butyric acid, a valeric acid, a caproic acid, an enanthic acid, a caprylic acid, a pelargonic acid, a capric acid, a lauric acid, a myristic acid, a pentadecanoic acid, a palmitic acid, a margaric acid, a stearic acid, an oleic acid, a linolic acid, a linolenic acid, an arachidonic acid, a docosahexaenoic acid and an eicosapentaenoic acid. Further, specific examples of the dicarboxylic acid include an oxalic acid, a malonic acid, a succinic acid, a glutaric acid, an adipic acid, a pimelic acid, a suberic acid, an azelaic acid, a sebacic acid, a maleic acid, a fumaric acid, a citraconic acid, an itaconic acid, a glutaconic acid, an n-dodecyl succinic acid, n-dodecenyl succinic acid, an isododecyl succinic acid, an isododecenyl succinic acid, an n-octyl succinic acid and an n-octenyl succinic acid. As the dicarboxylic acid, further provided can be aromatic dicarboxylic acids such as a phthalic acid, an isophthalic acid, a terephthalic acid and a naphthalene dicarboxylic acid. Further, examples of trivalent or more polycarboxylic acids include a trimellitic acid and a pyromellitic acid. In addition, acid anhydride and acid chloride of a trivalent or more polycarboxylic acid are usable. These carboxylic acids may be used singly, or in combination with at least two kinds.

Further, the ester compound contained in the releasing agent is possible to contain an ester compound formed by using the alcohol compound as described below in addition to an ester compound formed by using the foregoing long chain aliphatic alcohol compound. As alcohols other than the long chain aliphatic alcohol as described above, provided are the following monoalcohols, dials and trivalent and more polyalcohols.

Specific examples of monoalcohols include methanol, ethanol, and isopropyl alcohol. Further, examples of diols include ethylene glycol, diethylene glycol, triethylene glycol, 1,2-propylene glycol, 1,3-propylene glycol, 1,4-butane diol, 1,4-butylene diol, neopentyl glycol, 1,5-pentane glycol, 1,6-hexane glycol, 1,7-heptane glycol, 1,8-octane diol, 1,9-nonane diol and 1,10-decane diol. Further, specific examples of trivalent and more polyaliphatic alcohols include glycerin, trimethylol ethane, trimethylol propane, pentaerythritol, sorbitol, trisphenol PA, phenol novolac and cresol novolac. In addition, as to trivalent and more polyaliphatic alcohols, alkylene oxide adducts are usable as the above-described polyaliphatic alcohol. These alcohols are used singly or in combination with at least two kinds.

[Aliphatic Hydroxycarboxylic Acid Compound]

Next, an aliphatic hydroxycarboxylic acid compound contained in a releasing agent constituting a toner of the present invention will be described. As the aliphatic hydroxycarboxylic acid compound containable in the releasing agent constituting the toner of the present invention, cited can be the same aliphatic hydroxycarboxylic acid compound as described in the section of the foregoing ester compound. The aliphatic hydroxycarboxylic acid compounds are possible to be used for being contained singly or in combination with at least two kinds.

And, the aliphatic hydroxycarboxylic acid compound contained in the releasing agent is preferably one identical to the aliphatic hydroxycarboxylic acid component constituting the foregoing ester compound contained in the releasing agent. Specifically, when the ester compound is tribehenyl citrate, a citric acid is preferable as the aliphatic hydroxycarboxylic acid compound contained in the releasing agent.

The aliphatic hydroxycarboxylic acid compound contained in the releasing agent preferably has a content of 0.1-10% by weight, based on the total weight of the releasing agent, and more preferably has a content of 0.5-7% by weight.

In the present invention, generation of tacking can be reliably inhibited by making a content of the aliphatic hydroxycarboxylic acid compound contained in the releasing agent to fall within the above-described range. On the other hand, when the aliphatic hydroxycarboxylic acid compound contained in the releasing agent has a content of less than 0.1% by weight, generation of tacking tends not to be sufficiently inhibited. Further, when the aliphatic hydroxycarboxylic acid compound contained in the releasing agent has a content exceeding 10% by weight, humidity dependence upon electrification tends to be deteriorated.

[Long Chain Aliphatic Alcohol Compound]

The releasing agent constituting the toner of the present invention is preferably one containing a long chain aliphatic alcohol compound in addition to the foregoing ester compound and aliphatic hydrocarboxylic acid compound. And, as a long chain aliphatic alcohol compound containable in a releasing agent, provided is one identical to the long chain aliphatic alcohol compound described in the section of the foregoing compound. And, the foregoing long chain aliphatic alcohol compounds are possible to be used for being contained singly or in combination with at least two kinds.

At least one of the long chain alkyl alcohol compound and the long chain alkenyl alcohol compound which are contained in the foregoing releasing agent preferably has the same structure as that of an alcohol component constituting the ester compound contained in the forgoing releasing agent.

And, when the long chain aliphatic alcohol compound is contained in the releasing agent, the alcohol compound preferably has the same structure as that of the long chain aliphatic alcohol compound constituting the foregoing ester compound. Specifically, for example, when the ester compound is tribehenyl citrate, behenyl alcohol is preferably employed as the long chain aliphatic alcohol compound contained in the releasing agent.

The long chain aliphatic alcohol compound contained in the releasing agent preferably has a content of 2-15% by weight, based on the total weight of the releasing agent, and more preferably has a content of 3-12% by weight.

The generation of tacking can be reliably inhibited by making a content of the long chain aliphatic alcohol compound contained in the releasing agent to fall within the above-described range. That is, it would appear that when the long chain aliphatic alcohol compound contained in the releasing agent has a content of 2-15% by weight, based on the total weight of the releasing agent, a tacking generation-inhibitory effect is produced by the presence of the alcohol compound, in addition to the tacking generation-inhibitory effect caused by the aliphatic hydroxycarboxylic acid compound.

Appropriate hardness is provided at room temperature for the releasing agent by making a content of the long chain aliphatic alcohol compound contained in the releasing agent to fall within the above-described range, and hardness of the resulting fixed image surface can be arranged to be increased at room temperature, whereby high storage stability with no generation of tacking tends to be presumably obtained by improving detachability between the fixed images.

The releasing agent constituting the toner of the present invention will be described. The releasing agent constituting the toner of the present invention preferably has a content of 3-20% by weight, based on weight of the after-mentioned binder resin, and more preferably has a content of 5-18% by weight.

Further, the releasing agent constituting the toner of the present invention preferably has a melting point of 45-90° C., and more preferably has a melting point of 50-85° C.

The melting point of the releasing agent exhibits a peak top temperature at the maximum endothermic peak, and is measured via differential calorimetric analysis employing a differential calorimeter "DSC-7, manufactured by Perkin Elmer Corp.) and a thermal analyzer controller "TAC7/DX, manufactured by Perkin Elmer Corp.).

Specifically, 4.5 mg of the releasing agent are sealed in an aluminum pan (KIT NO. 0219-0041) to be placed in a sample holder "DSC-7", and temperature control of heat-cool-heat is conducted under the measurement conditions such as a measurement temperature of 0-200° C., a temperature rising rate of 10° C./minute, and a temperature lowering rate of 10° C./minute to conduct analysis based on data during the 2nd heating, provided that an empty aluminum pan has been used for the reference measurement.

Next, the binder resin and the colorant contained in the toner particle constituting the toner of the present invention will be described. The toner particle constituting the toner of the present invention contains at least a binder resin, a colorant and the foregoing releasing agent.

[Binder Resin]

When the toner of the present invention is manufactured by a pulverization method or a dissolution suspension method, usable examples of the binder resin constituting the toner include commonly known resins such as a styrene based resin, a (meth)acrylic resin, a stylene-(meth)acrylic copolymer resin, a vinyl based resin like an olefin based resin, a polyester based resin, a polyamide based resin, a polycarbonate resin, a polyether based resin, a polyurethane resin and a urea-modified polyester resin. These are possible to be used singly or in combination with at least two kinds.

Further, in cases where toner particles constituting the toner of the present invention are manufactured by a suspension polymerization method, a mini-emulsion polymerization coagulation method or an emulsion polymerization coagulation method, examples of polymerizable monomers to obtain a binder resin constituting the toner include vinyl based monomers such as styrene; a methacrylic acid ester derivative (for example, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate or phenyl methacrylate); an acrylic acid ester derivative (for example, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate or phenyl acrylate); an olefin (for example, ethylene, propylene or isobutylene); and an acrylic acid or methacrylic acid derivative (for example, acrylonitrile, methacrylonitile or acrylamide). These vinyl based monomers are possible to be used singly or in combination with at least two kinds.

Further, one having an ionic dissociative group as a polymerizable monomer is preferably used in combination. Examples of the polymerizable monomer having an ionic dissociative group include an acrylic acid, a methacrylic acid, a maleic acid, an itaconic acid, a cinnamic acid and a fumaric acid.

Further, the binder resin having a crosslinking structure can be obtained as the polymerizable monomer by using polyfunctional vinyl such as divinylbenzene, ethylene glycol dimethacrylate, ethylene glycol diacrylate, diethylene glycol dimethacrylate or diethylene glycol diacrylate.

Such a binder resin preferably has a weight average molecular weight Mw of 2,000-1,000,000, and more preferably has a weight average molecular weight Mw of 10,000-50,000. Further, a ratio Mw/Mn of weight average molecular weight Mw to number average molecular weight Mn is preferably 2-6, and more preferably 2.5-55.

Further, the binder resin preferably has a glass transition point temperature of 50-70° C., and more preferably has a glass transition point temperature of 55-70° C.

Further, the binder resin preferably has a softening point temperature of 80-110° C., and more preferably has a softening point temperature of 90-105° C.

Weight average molecular weight Mw of the binder resin is measured via gel permeation chromatogaphy (GPC). Specifically, employed area device "HLC-8220, manufactured by TOSOH Corp.) and a column (TSKguardcolumn+TSKgelSuper HZM-M 3Ren, produced by TOSOH Corp.). Tetrahydrofuran (THF) as a carrier solvent is allowed to flow at a flow rate of 0.2 ml/min while maintaining the column temperature at 40° C., and a measuring sample is dissolved in tetrahydrofuran at room temperature under the dissolution condition to conduct a treatment for 5 minutes employing an ultrasonic homogenizer so as to reach a concentration of 1 mg/ml. Next, a treatment is carried out employing a 0.2 μm pore size membrane filter to obtain a sample solution, and 10 μl of this sample solution is injected into the device with the above-described carrier solvent to conduct detection employing a refractive index detector (RI detector). The molecular weight distribution of the measuring sample is calculated from a calibration curve which has been obtained by employing monodispersed standard polystyrene particles. Ten polystyrene samples are used for the calibration curve measurement.

When the binder resin has a weight average molecular weight Mw of less than 2,000, bending fixability of the resulting toner is degraded, whereby image defects tend to be caused by peeling of images when bending a full color solid image. On the other hand, when the binder resin has a weight average molecular weight Mw exceeding 1,000,000, the resulting toner exhibits low heat-meltability in the fixing process for image formation, resulting in reduced fixing strength. An Mw/Mn of the binder resin of less than 2 easily causes high-temperature offset in the fixing process and an Mw/Mn of more than 6 results in deteriorated sharp-melt characteristic in the fixing process, leading to reduced transparency of the resulting toner and deteriorated color-mixing property of a full-color image, together with insufficient color reproduction. Further, a glass transition point temperature of the binder resin of lower than 50° C. results in insufficient heat resistance and coagulation of toner-to-toner is easily generated during storage. On the other hand, when a glass transition point temperature thereof is higher than 70° C., the resulting toner becomes difficult to be melted, resulting in degraded fixability and deteriorated color-mixing property of a full-color image, together with insufficient color reproduction. Further, when a softening point temperature of the binder resin is lower than 90° C., high-temperature offset is easy to be produced in the fixing process. On the other hand, when a softening point temperature thereof is higher than 110° C., fixing strength, transparency and a color-mixing property can not be sufficiently obtained, resulting in low glossiness of the resulting full-color image.

A volume-based median diameter of binder resin particles obtained in a binder resin particle polymerization process is preferably 30-500 nm, for example.

[Colorant]

Next, commonly known inorganic or organic colorants are usable as the colorant contained in a toner particle constituting the toner of the present invention. Specific colorants are shown below.

As a black colorant, for example, carbon black such as furnace black, channel black, acetylene black, thermal black or lampblack, and also magnetic powder of magnetite or ferrite are provided.

Further, examples of colorants for magenta or red include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 222, and so forth.

Further, examples of colorants for orange or yellow include C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 74, C. I. Pigment Yellow 93, C. I. Pigment Yellow 94, C. I. Pigment Yellow 138, and so forth.

Further, examples of colorants for cyan include C. I. Pigment Blue 15, C. I. Pigment Blue 16, C. I. Pigment Blue 60, C. I. Pigment Blue 62, C. I. Pigment Blue 66, and so forth.

The above-described colorants are possible to be used singly or in combination with at least two kinds.

Further, the colorant preferably has an addition amount of 1-30% by weight, based on the total weight of toner, and more preferably has an addition amount of 2-15% by weight.

Surface-modified colorants are also usable.

Next, the structure and form of the toner of the present invention will be described.

[Structure of Toner]

The structure and form are not specifically limited as long as the toner particle constituting the toner of the present invention contains at least a binder resin, a colorant and a releasing agent, and the commonly known structure and form are possible to be employed.

In such a situation, the toner of the present invention may have a structure called a so-called core/shell structure composed of a core particle containing a binder resin, a colorant and a releasing agent, and a shell layer made of a shell layer forming resin (hereinafter, referred to also as "shell resin") to cover the outer circumferential surface of the core particle. In this case, a resin having a higher glass transition point temperature than that of the binder resin constituting the core particle is preferable. Specifically a resin having a glass transition point temperature 20° C. higher than that of the binder resin is preferable. When the toner particle has a core/shell structure with a shell layer made of a resin having a high glass transition point temperature, the resulting toner does not produce coagulation of toner-to-toner during storage, resulting in a high heat resistance storage property.

The toner particle having a core/shell structure may be one in which the shell layer completely covers the core particle, or one in which the shell layer partly covers the core particle. Further, a part of the shell resin constituting the shell layer may be one in which domains or the like are formed in the core particle. Further, the shell layer may have a multilayer structure composed of at least two layers each made of a resin having a different composition.

[Particle Diameter of Toner Particle]

Next, the particle diameter and shape as the form of toner in the present invention will be described.

The toner of the present invention preferably possesses toner particles having a volume-based median diameter of 3-8 μm. When the volume-based median diameter is 3-8 μm, reproduction of fine lines, dots or the like is improved, whereby halftone images are improved. This toner particle diameter can be controlled by concentration of a coagulant in the coagulating/fusing process as well as the fusing time when the toner particles are prepared by the after-mentioned mini-emulsion method, for example.

The toner particle size distribution preferably has a CV value of 16-35, and more preferably has a CV value of 18-22.

The CV value is determined by following Equation (x), wherein the arithmetic average particle diameter means the mean value of the volume-based particle diameter x with respect to 25,000 toner particles, and is determined employing "Coulter Multisizer III" (manufactured by Beckman Coulter, Inc.).

CV value={(standard deviation)/(volume-based average particle diameter)}×100 Equation (x)

The volume-based median particle diameter of the toner can be measured and calculated employing a device in which a data processing computer system (manufactured by Beckman Coulter, Inc.) is connected to "Coulter Multisizer III" (manufactured by Beckman Coulter, Inc.) .

Specifically, 0.02 g of the toner are added in 20 ml of a surfactant solution (a surfactant solution obtained by diluting a neutral detergent containing a surfactant component with deionized water to disperse the toner), followed by being wetted and then subjected to ultrasonically dispersing for one minute to prepare a toner dispersion. This toner dispersion is injected into a beaker in which an electrolyte solution "ISOTON II" (produced by Beckman Coulter, Inc.) is charged, which is placed on a sample stand, with a pipette, until the concentration indicated by the measuring apparatus reaches 8%. Herein, this concentration range makes it possible to obtain highly reproducible measurement values. Using the measuring apparatus, under conditions of the measured particle count number of 25,000 and an aperture diameter of 50 μm, the frequency is calculated by dividing a measurement range of 1-30 μm into 256 parts, and the particle diameter at a point of 50% from the larger one of the volume accumulation ratio (volume $D_{50}$% diameter) is designated as the volume-based median diameter.

(Average Circularity of Toner Particle)

Further, as to the toner of the present invention, each toner particle constituting the toner preferably has an average circularity of 0.930-1.000, and more preferably has an average circularity of 0.950-0.995. That is, when the toner particle has an average circularity of 0.930-1.000, fixability is improved, and fixing offset tends not to be generated, since filling density of toner particles in the toner layer having been transferred onto an image support becomes high. Further, each toner particle tends not to be crushed, whereby contamination of a fictional electrification-providing member is reduced, and electrification of the toner is stabilized.

The average circularity of toner particles is referred to as a value measured by "FPIA-2100" (manufactured by Sysmex Corp.). Specifically, the toner is wetted with an aqueous solution containing a surfactant, followed by being dispersed via an ultrasonic dispersion treatment for one minute, and thereafter the dispersion of toner particles is photographed with "FPIA-2100" (manufactured by Sysmex Corp.) in an HPF (high magnification photographing) mode at an appropriate density of the HPF detection number of 3,000-10,000 as a measurement condition. The circularity of each toner particle is calculated according to Equation (y) described below. Then, the average circularity is calculated by summing the circularities of each of the toner particles and dividing the resulting value by the total number of the toner particles. The HPF detection number falling within the above-described range makes it possible to realize reproduction.

Circularity=(circumference length of a circle having an area equivalent to a projection of a particle)/(circumference length of a projection of a particle) Equation (y)

Next, the method of manufacturing the toner of the present invention will be described.

[Method of Manufacturing Toner]

Methods of manufacturing the toner of the present invention are not specifically limited, and examples thereof include a pulverization method, a suspension polymerization method, a mini-emulsion polymerization coagulation method, an emulsion polymerization coagulation method, a dissolution suspension method and a polyester molecule elongation method. Of these methods, the mini-emulsion polymerization coagulation method is specifically preferred, in which, in an aqueous medium containing a surfactant at a concentration lower than the critical micelle concentration, a polymerizable monomer solution containing a releasing agent dissolved in a polymerizable monomer is dispersed by employing mechanical energy to form oil droplets (10-1000 nm in size) to prepare a dispersion; to the prepared dispersion, a water-soluble polymerization initiator is added to perform radical polymerization to obtain binder resin particles; the obtained binder resin particles were coalesced (coagulating/fusing) to obtain a toner.

In addition, in the foregoing mini-emulsion polymerization coagulation method, an oil-soluble polymerization initiator may be added into the monomer solution, in place of or concurrently with addition of the water-soluble polymerization initiator.

As the method of manufacturing the toner of the present invention, binder resin particles formed in the mini-emulsion polymerization coagulation method may be arranged to be used for a structure of at least two layers. In this ease, a polymerization initiator and a polymerizable monomer are added into a dispersion of first resin particles prepared by mini-polymerization according to the conventional manner (the first stage polymerization), and this system can be utilized for a polymerization treatment (the second stage polymerization).

The aqueous medium is referred to as a medium composed mainly of water (at least 50% by weight). A component other than water is a water-soluble organic solvent. Examples thereof include methanol, ethanol, isopropanol, butanol, acetone, methyl ethyl ketone and tetrahydrofuran.

A method of dispersing a polymerizable monomer solution in an aqueous medium is not specifically limited, but a method of dispersing via mechanical energy is preferable. Dispersing machines to perform ail-droplet dispersion by using mechanical energy are not specifically limited and examples thereof include "CLEAR MIX", an ultrasonic homogenizer, a mechanical homogenizer, a Manton-Gaulin homogenizer and a pressure homogenizer. The dispersed particle diameter is preferably within the range of 10-1000 nm, and more preferably 30-300 nm.

[External Additive]

Herein, external additives used in the external additive treatment process will be described. In order to improve flowability, electrification and cleaning ability, so-called external additives can be added into the toner used for electrophotographic system image formation to improve toner performance. These external additives are not specifically limited, and various inorganic particles, organic particles and lubricants are usable.

Inorganic oxide particles of silica, titania, alumina and the like are preferably used for inorganic particles. The inorganic particles may be surface-treated preferably by using a silane coupling agent, titanium coupling agent and the like to enhance hydrophobicity. Spherical organic particles having an average primary particle diameter of 10-2000 nm are also usable. Polystyrene, poly(methyl methacrylate), styrene-methyl methacrylate copolymer and the like are usable as organic particles.

These external additives are incorporated to the toner preferably in an amount of 0.1-0.5% by weight, and more preferably 0.5-4.0% by weight. External additives may be used singly or in combination.

[Charge Control Agent]

Further, a charge control agent may be contained in a toner particle constituting the toner of the present invention, if desired. Commonly known various compounds are usable as the charge control agent.

[Developer]

Next, the developer prepared by using the toner of the present invention will be described. The case where the toner of the present invention is used as a single component magnetic toner by containing a magnetic material, for example; The case where the toner of the present invention is used as a two-component developer via mixture with so-called carrier; and the case where a nonmagnetic toner is used singly are taken into account, and any of them is preferably usable.

When the toner of the present invention is used as the two-component developer mixed with the carrier, generation of toner filming on the carrier (carrier contamination) can be inhibited. In the case of being used as a single-component developer, generation of toner filming with respect to a frictional electrification member for a developing device can be inhibited.

As the carrier constituting the two-component developer, there may be utilized magnetic particles made of a conventionally known conventional material such as metal like iron, ferrite or magnetite, and an alloy of the foregoing metal and metal like aluminum or lead. Specifically, ferrite particles are preferable.

The carrier having a volume average particle diameter of 15-100 μm is preferable, and the carder having a volume average particle diameter of 25-60 μm is more preferable. The volume average particle diameter of the carrier can be measured with a laser diffraction system particle size distribution meter "HELOS" (manufactured by SYMPATEC Co.).

As the carrier, preferably used are a carrier further coated with a resin or a so-called resin dispersion type carrier prepared by dispersing magnetic particles in a resin. A resin composition for the coating is not specifically limited, but examples thereof include an olefin based resin, styrene based resin, a styrene-acryl based resin, a silicone based resin, an ester based resin and a fluorine-containing polymer based resin. Further, a resin to form the resin dispersion type carrier is not specifically limited, and any of those known in the art can be used. Usable examples thereof include a styrene-acryl based resin, a polyester resin, a fluorine based resin and a phenol based resin.

[Image Forming Method]

Next, an image forming method in which the toner of the present invention is utilized will be described. The toner of the present invention is preferably usable for the image forming method possessing a fixing step with a contact-heating system. The fixing temperature in the fixing step is a relatively low fixing temperature of 100-200° C., and preferably a relatively low fixing temperature of 120-180° C. as the surface temperature of an image support, that is, this is preferably usable for an image forming method to fix at 120-200° C. as the surface temperature of a heating member in a fixing nip section.

Examples of the contact-heating system include a heat-pressing fixing system, a heat roller fixing system, and a pressing contact-heating fixing system by which fixing is conducted by a rotatable pressing member in which a heater having been fixedly placed is enclosed.

In this image forming method, specifically, such a toner described above is used. An electrostatic image electrostatically formed on an electrostatic latent image cancer is visualized by charging a developer with a frictional electrification member in a developing device to obtain a toner image, and this toner image is transferred into an image support. Thereafter, the toner image having been transferred onto the image support is fixed to the image support via a fixing treatment of the contact-heating system to obtain a visible image.

[Image Support]

Specific examples of the image support on which images are formed in the above-described image forming method include ordinary paper sheets from thick paper sheets to thin paper sheets, high quality paper sheets, coated printing paper such as art paper or coat paper, commercially available Japanese paper and post card paper, plastic films for OHP, and various items such as cloth and so forth, but the present invention is not limited thereto.

EXAMPLE

Next, examples conducted to confirm the effect of the present invention will be described, but the present invention is not limited to these examples.

Preparation Example 1 of Releasing Agent

Heated to 80° C. were 177.2 g of tribehenyl citrate (a melting point of 75.6° C.) to add 12.4 g of behenyl alcohol and 1.77 g of a citric acid, and the system was mixed for 20 minutes employing a kneader to obtain releasing agent [1].

Synthetic Example 1 of Binder Resin Particles

Heated and mixed were 201.5 g of styrene, 117.24 g of n-butyl acrylate, 18.31 g of a methacrylic acid and the above-described releasing agent [1] to prepare a releasing agent-containing monomer solution.

A surfactant solution in which 11.3 g of an anionic surfactant "EMAL E27C" (produced by KAO Co., Ltd.; an active component of 27%) was dissolved in 1107.05 g of deionized water was prepared, and maintained to a temperature of 80° C.

The above-described releasing agent-containing monomer solution was charged in the surfactant solution, and the system was stirred at high speed employing "CLEAR MIX" (manufactured by M Technique Co., Ltd.) to prepare a monomer emulsified liquid.

A 5 liter four-necked stainless reaction vessel was fitted with a stirrer, a cooling tube, a nitrogen introducing device and a temperature sensor, and 1005.59 g of deionized water and 235.79 g of latex {monomer composition: methylacrylate/butylacrylate/itaconic acid=78.5/16.5/5 (weight ratio); a solid content of 30%; an average particle diameter of 130 nm; and Mw 15,000} were added in the reaction vessel. The internal temperature was raised to 70° C., and the above-described monomer emulsified liquid was added while stirring under nitrogen flow.

An aqueous polymerization initiator solution in which 11.41 g of potassium persulfate were dissolved in 216.72 g of deionized water was added while stirring at the maintained internal temperature, and 5.23 g of n-octyl mercaptan were further dropped therein spending 5 minutes to subsequently conduct polymerization reaction at the same temperature for 40 minutes. Next, an aqueous polymerization initiator solution in which 9.96 g of potassium persulfate were dissolved in 186.25 g of deionized water was added, a mixed solution of 366.14 g of styrene, 179.12 g of n-butyl acrylate and 8.63 g of n-octyl mercaptan was dropped therein spending one hour, and the polymerization reaction was further conducted for one hour to obtain latex of binder resin particle [1].

This binder resin particle [1] had a volume-based median diameter of 190 nm, and weight average molecular weight Mw of 17,500. In addition, the volume-based median diameter and weight average molecular weight Mw of binder resin particles were measured by the same method as described above.

Synthetic Examples 2-15 of Binder Resin Particles

Latexes of binder resin particles [2]-[9] and [11]-[15], and binder resin particle [10] for a comparative example were obtained similarly to Synthetic example 1 of binder resin particles, except that the composition of the releasing agent was changed as shown in the following Table 1. In addition, the addition amount of an ester compound was set to 177.2 g for each of synthetic examples 1-15 of binder resins.

TABLE 1

| | Releasing agent | | | | | Binder resin | |
|---|---|---|---|---|---|---|---|
| | | | | Long chain aliphatic alcohol acid | | | |
| Binder resin particle No. | Kinds of ester compound | Aliphatic hydroxycarboxilic acid Kinds | Aliphatic hydroxycarboxilic acid Addition amount (g) | Kinds | Addition amount (g) | Weight average molecular weight Mw | Volume-based median diameter (nm) |
| 1 | tribehenyl citrate | citric acid | 1.77 | behenyl alcohol | 12.4 | 17,500 | 190 |
| 2 | tribehenyl citrate | citric acid | 0.89 | behenyl alcohol | 12.4 | 18,700 | 230 |
| 3 | tribehenyl citrate | citric acid | 5.32 | behenyl alcohol | 12.4 | 17,600 | 243 |
| 4 | tribehenyl citrate | citric acid | 14.18 | behenyl alcohol | 12.4 | 19,000 | 215 |
| 5 | tribehenyl citrate | citric acid | 7.08 | behenyl alcohol | 12.4 | 18,200 | 220 |
| 6 | tribehenyl citrate | citric acid | 8.60 | — | — | 18,500 | 223 |
| 7 | stearyl citrate | citric acid | 1.77 | stearyl alcohol | 12.4 | 17,900 | 231 |
| 8 | distearyl malate | malic acid | 1.77 | stearyl alcohol | 12.4 | 18,100 | 219 |
| 9 | distearyl tartrate | tartaric acid | 1.77 | stearyl alcohol | 12.4 | 19,300 | 208 |
| 10 | tribehenyl citrate | — | — | — | — | 17,600 | 224 |
| 11 | tribehenyl citrate | malic acid | 1.77 | steaiyl alcohol | 12.4 | 17,200 | 200 |
| 12 | tribehenyl citrate | tartaric acid | 1.77 | stearyl alcohol | 12.4 | 18,000 | 237 |
| 13 | distearyl malate | citric acid | 1.77 | stearyl alcohol | 12.4 | 17,700 | 244 |
| 14 | distearyl tartrate | citric acid | 1.77 | stearyl alcohol | 12.4 | 17,900 | 234 |
| 15 | distearyl tartrate | malic acid | 1.77 | — | — | 17,300 | 240 |

Synthetic Example 1 of Shell Resin Particle

A surfactant solution in which 2.3 g of an anionic surfactant "EMAL E27C" (produced by KAO Co., Ltd.) was dissolved in 2948 g of deionized water was charged in a 5 liter stainless reaction vessel fitted with a stirrer, a cooling tube, a nitrogen introducing device and a temperature sensor, and an aqueous polymerization initiator solution in which 10.2 g of potassium persulfate were dissolved in 218 g of deionized water was added while stirring at 80° C. under nitrogen flow. After a monomer solution in which 520 g of styrene, 184 g of n-butyl acrylate, 96 g of methacrylic acid and 22.1 g of n-octyl mercaptan were mixed was further dropped therein spending 3 hours, and the system was maintained at the same temperature for one hour to complete polymerization reaction, the internal temperature was cooled to room temperature to obtain latex of shell resin particle [1]. This shell resin particle [1] had a volume-based median diameter of 82 nm, and weight average molecular weight Mw of 13,200.

Preparation Example 1 of Cyan Colorant Particle Dispersion

After 25 g of a cyan pigment C.I. Pigment Blue 15:3 (copper phthalocyanine pigment) was added into a surfactant solution in which 11.5 g of sodium dodecyl sulfate were dissolved in 160 g of deionized water, a dispersing treatment was conducted employing "CLEAR MIX W-MOTION CLM-0.8" (produced by M Technique Co.) to obtain cyan colorant particle dispersion [1]. When the particle diameter of cyan colorant particles in this cyan colorant particle dispersion [1] was measured employing an electrophoretic light scattering photometer ELS-800 (manufactured by Otsuka Electronics Co., Ltd.), an volume-based median diameter of 138 nm was obtained.

Preparation Example 1 of Toner

In a 5 liter stainless reaction vessel fitted with a stirrer, a cooling tube, and a temperature sensor, charged were 1461.42 g of latex of binder resin particle [1], 1671.4 g of deionized water and 147.31 g of cyan colorant particle dispersion [1], and 5N-sodium hydroxide was introduced while stirring to adjust a pH to 10. Next, an aqueous magnesium chloride solution in which 56.66 g of magnesium chloride hexahydrate were dissolved in 56.66 g of deionized water was dropped spending 10 minutes while stirring and heated to an internal temperature of 75° C. to measure the particle diameter employing "Coulter Counter TA-II" (manufactured by Beckman Coulter Co.), and heating while stirring was conducted until the average particle diameter reached 6.5 μm. At a time when the average particle diameter reached 6.5 μm, one in which 244.18 g of latex of shell resin particle [1] were adjusted with an aqueous 5N-sodium hydroxide solution was dropped, and heating while stirring was continued until shell resin particle [1] was attached onto the surface of the coagulated particle. At a time when the supernatant becomes transparent by centrifugally separating a small amount of the reaction solution with a centrifuge, an aqueous sodium chloride solution in which 73 g of sodium chloride were dissolved in 291.98 g of deionized water was added, heating while stirring was further continued, and the internal temperature was cooled to room temperature at a time when the average circularity reached 0.965 via measurement employing a flow type particle image measuring device "FPIA-2100" (manufactured by Sysmex Corp.). Then, the resulting particles were washed with deionized water and filtrated repeatedly, and subsequently dried with warm air at 30° C. to obtain toner mother particle [1] having a structure of the present invention.

This toner mother particle [1] had a volume-based median diameter of 6.48 μm, and an average circularity of 0.966.

[External Additive Treatment]

To toner mother particle [1], 1% by weight of hydrophobic silica (having a number average primary particle diameter of 12 nm and a hydrophobicity degree of 68) and 1% by weight of hydrophobic titanium dioxide (having a number average primary particle diameter of 20 nm and a hydrophobicity degree of 64) were added and mixed employing a Henschel mixer (produced by Mitsui Miike Kakoki Co.). Thereafter, coarse particles were removed using a sieve having an opening of 45 μm to prepare toner [1] composed of toner particle [1]. Incidentally, as to toner mother particles, addition of hydrophobic silica causes no variation in particle size.

Preparation Examples 2-15 of Toner

Toner mother particles [2]-[15] were obtained similarly to preparation example 1 of toner, except that latex of binder resin particle [1] was replaced by each of latexes of binder resin particles [2]-[15], and Toners [2]-[15] composed of toner particles [2]-[15], respectively were prepared by conducting an external additive treatment similarly to preparation example 1 of toner.

[Preparation of Developer]

A ferrite carrier coated with a styrene-acrylic resin, which had a volume-based median diameter of 35 μm was mixed in each of the above-described toners [1]-[15] in such a way that the foregoing toner had a content of 8% by weight to prepare developers [1]-[15] as two-component developers. In addition, developers [1]-[9] and [11]-[15] are those employing the toners of the present invention, and developer [10] is comparative one.

Examples 1-9, 11-15, and Comparative Example 1

Evaluations of the following (1)-(4) were made employing each of developers [1]-[15].

(1) High Temperature Offset

After a machine obtained by modifying a commercially available digital copying machine "bizhub PRO C650" (manufactured by Konica Minolta Business Technologies, Inc.) was employed in such a way that as for a fixing device, the surface temperature of a heat roller for fixing was possible to be varied in the range of 100-210° C., and an A4 plain paper sheet was longitudinally conveyed to fix a solid belt-shaped image having a width of 5 mm, which expands in the direction perpendicular to the conveyance direction, a fixing experiment by which a solid belt-shaped image having a width of 5 mm and a halftone image having a width of 20 mm, which expand in the direction perpendicular to the conveyance direction were fixed was repeatedly conducted while varying the fixing temperature to be set at 5° C. intervals in the increasing manner such as 100° C., 105° C. and so forth until a stained image caused by high temperature offset was observed, and the fixing temperature in the fixing experiment in which the stained image caused by high temperature offset was observed was measured as a temperature of high temperature offset. Results are shown in Table 2.

(2) Fixability

A solid image having a toner coating amount of 11 mg/cm$^2$ was formed at low temperature and low humidity (a temperature of 10° C. and a humidity of 10% RH) employing the above-described modified machine, and the resulting solid image was folded with a folding machine. Air at 0.35 MPa was sprayed onto the resulting, and the peeling experiment in which the fold was evaluated as each of 5 ranks from rank 5 to rank 1, referring to a limit sample was repeatedly conducted while varying the fixing temperature to be set at 5° C. intervals in the decreasing manner such as 210° C., 205° C. and so forth to measure the fixing temperature in the peeling experiment, which was initially evaluated as rank 3, as a fixing lower limit temperature. Results are shown in Table 2.

Evaluation Criteria

Rank 5: No peeling is observed at the fold at all.

Rank 4: Partial peeling is observed along the fold.

Rank 3: Fine line-shaped peeling was observed along the fold.

Rank 2: Thick peeling was observed along the fold.

Rank 1: Large peeling is observed on an image.

(3) Heat Resistance Storage Property

In a 10 ml vial having an inner diameter of 21 mm, charged were 0.5 g of toner, and after closing the lid of it, each vial was then shaken 600 times with a tap densor, "KYT-2000 (produced by Seishin Kigyo Co., Ltd.)" and after removing the lid of it, the vial was left standing for two hours at 57° C. and 35% RH. Next, the toner was placed on a sieve of 48 mesh (an opening of 350 μm) so as no to damage the toner and was set on a powder tester (produced by Hosokawa Micron Co. Ltd.), while securing it with a pressure bar and a knob nut, and the powder tester was adjusted to a vibration intensity of a feeding width of 1 mm to apply vibration thereto for 10 seconds. Thereafter, the amount of toner remaining on the sieve was measured, and a toner aggregation ratio was calculated by the following equation to be evaluated in accordance with the following evaluation criteria. Results are shown in Table 2.

$$\text{Toner aggregation ratio (\% by weight)} = \{\text{Remaining amount of toner (g)}\}/0.5\ \text{(g)}]\times 100 \qquad \text{Equation (1)}$$

Evaluation Criteria

A: A toner aggregation ratio of less than 15% by weight (Excellent)

B: A toner aggregation ratio of 15-20% by weight (Good)

C: A toner aggregation ratio exceeding 20% (No good)

(4) Tacking

After two unfixed images were prepared employing the above-described modified machine, and fixed at a fixing temperature of 150° C. with an external fixing device, the first image portion is placed so as to face both the second non-image portion and the second image portion, and a weight is placed on the piled area so as to apply a load of 80 g/cm$^2$. The foregoing situation was left standing for 3 days in a constant temperature and constant humidity reservoir at a temperature of 60° C. and a humidity of 50% RH. Thereafter, image defects of two fixed images having been piled were evaluated in accordance with the following criteria. Results are shown in Table 2.

Evaluation Criteria

"Excellent": No image defect caused by toner transfer is generated, and even slight tacking between image portions is not observed, resulting in no problem at all.

"Good": A zipping sound is made when separating piled images from each other, but no image defect is generated, resulting in no problem.

"Practically accepted": After separating piled images from each other, gloss unevenness is generated in both image portions, but no image defect is almost observed.

"No good": Peeling caused by transfer to the non-image portion and toner transfer between image portions is observed, resulting in no practical availability.

TABLE 2

| | | | Toner properties | | Evaluation results | | | | |
|---|---|---|---|---|---|---|---|---|---|
| | | | | | | Fixing lower | Heat resistance storage property | | |
| | Toner No. | Binder resin particle No. | Volume-based median diameter (μm) | Average circularity | High temperature offset | limit temperature | Toner aggregation ratio | Evaluation | Tacking |
| Example 1 | 1 | 1 | 6.52 | 0.964 | Not less than 210° C. | 115° C. | 8% | A | Excellent |
| Example 2 | 2 | 2 | 6.61 | 0.967 | Not less than 210° C. | 115° C. | 11% | A | Excellent |
| Example 3 | 3 | 3 | 6.49 | 0.966 | Not less than | 115° C. | 6% | A | Excellent |
| Example 4 | 4 | 4 | 6.58 | 0.965 | 205° C. | 110° C. | 7% | A | Excellent |
| Example 5 | 5 | 5 | 6.53 | 0.968 | Not less than 210° C. | 125° C. | 12% | A | Good |
| Example 6 | 6 | 6 | 6.60 | 0.961 | Not less than 210° C. | 125° C. | 11% | A | Excellent |
| Example 7 | 7 | 7 | 6.50 | 0.964 | Not less than 210° C. | 120° C. | 16% | B | Good |
| Example 8 | 8 | 8 | 6.59 | 0.963 | Not less than 210° C. | 115° C. | 13% | A | Good |
| Example 9 | 9 | 9 | 6.46 | 0.964 | Not less than 210° C. | 120° C. | 15% | B | Good |
| Example 10 | 11 | 11 | 6.48 | 0.964 | 205° C. | 120° C. | 14% | A | Good |
| Example 11 | 12 | 12 | 6.53 | 0.963 | 205° C. | 120° C. | 15% | B | Good |
| Example 12 | 13 | 13 | 6.57 | 0.964 | 205° C. | 120° C. | 13% | A | Good |
| Example 13 | 14 | 14 | 6.49 | 0.965 | 205° C. | 120° C. | 14% | A | Good |
| Example 14 | 15 | 15 | 6.55 | 0.968 | 205° C. | 120° C. | 15% | B | Good |
| Comparative example 1 | 10 | 10 | 6.72 | 0.965 | 205° C. | 125° C. | 19% | B | No good |

As is clear from Table 2, it was confirmed that as to Examples 1-9 and 11-15 employing the toner of the present invention, excellent results were obtained with respect to any of the evaluation items. On the other hand, it was confirmed that Comparative example 1 employing a toner which is not the toner of the present invention resulted in "no good" of tacking, and exhibited inferior toner performance to that of the present invention.

The invention claimed is:

1. An electrophotographic toner comprising a binder resin, a colorant and a releasing agent, wherein the releasing agent comprises an ester compound and an aliphatic hydroxycarboxylic acid compound, wherein the aliphatic hydroxycarboxylic acid is at least one selected from a group consisting of a citric acid, a malic acid and a tartaric acid, wherein the ester compound comprises an ester formed by reacting an aliphatic hydroxycarboxylic acid compound and at least one of a long chain alkyl alcohol compound and a long chain alkenyl alcohol compound, and wherein the aliphatic hydroxycarboxylic acid compound contained in the releasing agent has a content of 0.1-10% by weight, based on a total weight of the releasing agent.

2. The electrophotographic toner of claim 1, wherein the aliphatic hydroxycarboxylic acid compound contained in the releasing agent has a content of 0.5-7% by weight, based on the total weight of the releasing agent.

3. The electrophotographic toner of claim 1, wherein an aliphatic hydroxycarboxylic acid compound reacted to form the ester compound contained in the releasing agent has the same structure as that of the aliphatic hydroxycarboxylic acid compound contained in the releasing agent.

4. The electrophotographic toner of claim 1, wherein an alcohol component constituting the ester compound has 16-40 carbon atoms.

5. The electrophotographic toner of claim 1, wherein the releasing agent comprises at least one of the long chain alkyl alcohol compound and the long chain alkenyl alcohol compound, and at least one of the long chain alkyl alcohol compound and the long chain alkenyl alcohol compound in the releasing agent has a content of 2-15% by weight, based on the total weight of the releasing agent.

6. The electrophotographic toner of claim 5, wherein at least one of the long chain alkyl alcohol compound and the long chain alkenyl alcohol compound in the releasing agent has the same structure as that of an alcohol component reacted to form the ester compound contained in the releasing agent.

* * * * *